US009570825B2

(12) United States Patent
Ozaki et al.

(10) Patent No.: US 9,570,825 B2
(45) Date of Patent: Feb. 14, 2017

(54) SUBSTRATE TERMINAL

(71) Applicant: Yazaki Corporation, Tokyo (JP)

(72) Inventors: Shinya Ozaki, Shizuoka (JP); Yoshihito Imaizumi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/945,638

(22) Filed: Nov. 19, 2015

(65) Prior Publication Data

US 2016/0149321 A1 May 26, 2016

(30) Foreign Application Priority Data

Nov. 21, 2014 (JP) ..... 2014-236796

(51) Int. Cl.
*H01R 12/00* (2006.01)
*H01R 12/71* (2011.01)
(Continued)

(52) U.S. Cl.
CPC ..... *H01R 12/716* (2013.01); *H01R 12/58* (2013.01); *H01R 13/405* (2013.01)

(58) Field of Classification Search
CPC . H01R 13/6658; H01R 13/658; H01R 23/025; H01R 23/7068; H01R 31/06; H01R 12/57; H01R 9/091; H01R 23/725; H01R 43/0256; H05K 3/3426
(Continued)

(56) References Cited

U.S. PATENT DOCUMENTS 4,503,609 A * 3/1985 Mackay ..... H01L 21/4853 29/843
4,679,881 A * 7/1987 Galvin ..... H01R 4/2433 439/392
(Continued)

FOREIGN PATENT DOCUMENTS

JP 3-126361 U 12/1991
JP 9-306610 A 11/1997
(Continued)

OTHER PUBLICATIONS

Communication dated Nov. 8, 2016 from the Japanese Patent Office in counterpart Application No. 2014-236796.

*Primary Examiner* — Abdullah Riyami
*Assistant Examiner* — Vladimir Imas
(74) *Attorney, Agent, or Firm* — Sughrue Mion, PLLC

(57) ABSTRACT

A substrate terminal includes at least one substrate connection portion that is inserted into a hole portion in a substrate from one surface side of the substrate and is soldered together with the hole portion, a terminal connection portion into which an opposite-side terminal is inserted in a direction same as an insertion direction of the substrate connection portion into the hole portion and that is connected to the opposite-side terminal, an intermediate portion that connects the substrate connection portion and the terminal connection portion, and at least one substrate abutting portion that is made to project in a direction orthogonal to the insertion direction and is made to abut against the one surface of the substrate with the substrate connection portion and the hole portion soldered. The substrate abutting portion is formed on a base member by bending processing.

14 Claims, 4 Drawing Sheets

(51) Int. Cl.
*H01R 12/58* (2011.01)
*H01R 13/405* (2006.01)

(58) Field of Classification Search
USPC ..... 439/76.1, 76.2, 83
See application file for complete search history.

(56) References Cited

U.S. PATENT DOCUMENTS 4,790,764 A * 12/1988 Kawaguchi ..... H01R 13/052 439/746
5,078,625 A * 1/1992 Anzai ..... F21S 48/212 439/356
5,729,436 A * 3/1998 Yoshigi ..... B60R 16/0239 361/752
6,309,259 B1 * 10/2001 Yamashita ..... H01R 12/585 439/439
6,345,999 B1 * 2/2002 Okuyama ..... H01R 13/193 439/268
6,488,551 B1 * 12/2002 Tomlin ..... H01R 9/2458 439/47
6,848,915 B1 * 2/2005 Perhats, Sr. ..... H01R 4/48 439/76.2
6,905,348 B2 * 6/2005 Naitou ..... H01R 9/2458 439/76.2
2001/0041467 A1 11/2001 Kikuchi et al.
2002/0124994 A1 9/2002 Tanaka et al.
2002/0131239 A1 9/2002 Ashiya et al.
2002/0163783 A1 11/2002 Ashiya et al.
2016/0149325 A1 * 5/2016 Imaizumi ..... H01R 12/772 439/83

FOREIGN PATENT DOCUMENTS

JP 2001-319716 A 11/2001
JP 2002-270263 A 9/2002
JP 2002-270982 A 9/2002
JP 2002-271077 A 9/2002
JP 3432378 B2 8/2003
JP 2003-272737 A 9/2003
JP 2006-066122 A 3/2006
JP 2007-095629 A 4/2007

* cited by examiner

SUBSTRATE TERMINAL

CROSS-REFERENCE TO RELATED APPLICATION(S)

The present application claims priority to and incorporates by reference the entire contents of Japanese Patent Application No. 2014-236796 filed in Japan on Nov. 21, 2014.

BACKGROUND OF THE INVENTION

1. Field of the Invention

The present invention relates to a substrate terminal.

2. Description of the Related Art

Conventionally, a substrate terminal that is soldered to an electronic circuit substrate (hereinafter, referred to as a "substrate") has been known. The substrate terminal has one or a plurality of substrate connection portion(s). The substrate connection portion is inserted into a corresponding hole portion on the substrate and is soldered together with a land on a peripheral edge of the hole portion (through-hole). In this manner, the substrate terminal is fixed to the substrate. For example, Japanese Patent Application Laid-open No. 2006-66122, Japanese Patent Application Laid-open No. 2007-95629, Japanese Patent Application Laid-open No. 2003-272737, Japanese Patent Application Laid-open No. 2002-270263, and Japanese Patent Application Laid-open No. 2001-319716 disclose substrate terminals. Japanese Patent Application Laid-open No. 2001-319716 discloses a substrate terminal that is freely detachable from a substrate and the configuration of a substrate connection portion that does not need soldering.

When an opposite-side terminal is connected to the substrate terminal, pressing force from the opposite-side terminal acts on the substrate terminal with an insertion operation of the opposite-side terminal into the substrate terminal. Depending on usage modes, the opposite-side terminal is detached from the substrate terminal in some cases. When the opposite-side terminal is detached, tensile force in the detachment direction acts on the substrate terminal from the opposite-side terminal. For example, in the substrate terminals as disclosed in Japanese Patent Application Laid-open No. 2006-66122 and Japanese Patent Application Laid-open No. 2007-95629, a solder portion between the substrate connection portion and the hole portion in the substrate receives the pressing force and the tensile force. In the substrate terminal as disclosed in Japanese Patent Application Laid-open No. 2003-272737, a resin housing to which the substrate terminal is fixed once receives the pressing force and the tensile force from the opposite-side terminal but there is a possibility that the resin housing is not strong enough to support the pressing force and the tensile force and a solder portion receives them. Thus, the conventional substrate terminals have a risk that an electric connection state between the substrate terminal and a wiring of the substrate is deteriorated because load on the solder portion of the substrate terminal is large in attachment and detachment between the terminals. The substrate terminal as disclosed in Japanese Patent Application Laid-open No. 2002-270263 is molded into a crank form and an intermediate portion opposing the surface of the substrate is provided between the substrate connection portion and a terminal connection portion with the opposite-side terminal. In the substrate terminal, the intermediate portion is held between two plates made of resin. The substrate terminal reduces load on a solder portion in attachment and detachment between the terminals with the configuration in which one plate receives the pressing force when the opposite-side terminal is inserted and the other plate receives the tensile force when the opposite-side terminal is detached. The substrate terminal, however, needs the plates separately. This possibly results in increase of the substrate with the terminal in size and weight and increase in cost with increase in the number of parts.

SUMMARY OF THE INVENTION

It is an object of the present invention to provide a substrate terminal capable of reducing load on a solder portion with a simple configuration.

In order to achieve the above mentioned object, substrate terminal according to one aspect of the present invention includes at least one substrate connection portion configured to be inserted into a hole portion in a substrate from one surface side of the substrate and to be soldered together with the hole portion; a terminal connection portion into which an opposite-side terminal is inserted in a direction same as an insertion direction of the substrate connection portion into the hole portion and configured to be connected to the opposite-side terminal; an intermediate portion configured to connect the substrate connection portion and the terminal connection portion; and at least one substrate abutting portion configured to be made to project in a direction orthogonal to the insertion direction and to be made to abut against the one surface of the substrate in a state where the substrate connection portion and the hole portion are soldered, wherein the substrate abutting portion is formed on a base member, including the substrate abutting portion, the substrate connection portion, the terminal connection portion, and the intermediate portion, by bending processing with a side that includes a front end part of the substrate connection portion serving as a projecting end in a projecting direction, a root side of the substrate connection portion serving as a base point of the projection, and the base point serving as a bending portion.

Herein, in the substrate terminal according to another aspect of the present invention, it is desirable that the substrate connection portion, the terminal connection portion, and the intermediate portion are disposed on the same plane.

Further, it is desirable that the substrate terminal according to still another aspect of the present invention further includes an accommodation chamber abutting portion configured to abut against a terminal accommodation chamber attached to the substrate and accommodating the terminal connection portion, wherein the accommodation chamber abutting portion is desirably formed so as to be locked at an abutment point against the terminal accommodation chamber in a state where the substrate abutting portion and the substrate are abutted against each other when a force in an opposite direction to the insertion direction acts.

Further, in the substrate terminal according to still another aspect of the present invention, it is desirable that the substrate abutting portion is integrated with the accommodation chamber abutting portion and is held between the terminal accommodation chamber and the one surface of the substrate.

Further, in the substrate terminal according to still another aspect of the present invention, it is desirable that the substrate abutting portion is held between the terminal accommodation chamber attached to the substrate and accommodating the terminal connection portion and the one surface of the substrate.

Further, in the substrate terminal according to still another aspect of the present invention, it is desirable that the two substrate connection portions are provided at an interval, and the substrate abutting portion is made to project from between root sides of the two substrate connection portions.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, embodiments of a substrate terminal in the present invention will be described in detail with reference to the drawings. It should be noted that the embodiments do not limit the present invention.

Embodiments

One embodiment of the substrate terminal in the present invention will be described with reference to FIG. 1 to FIG. 2.

Figure 1:
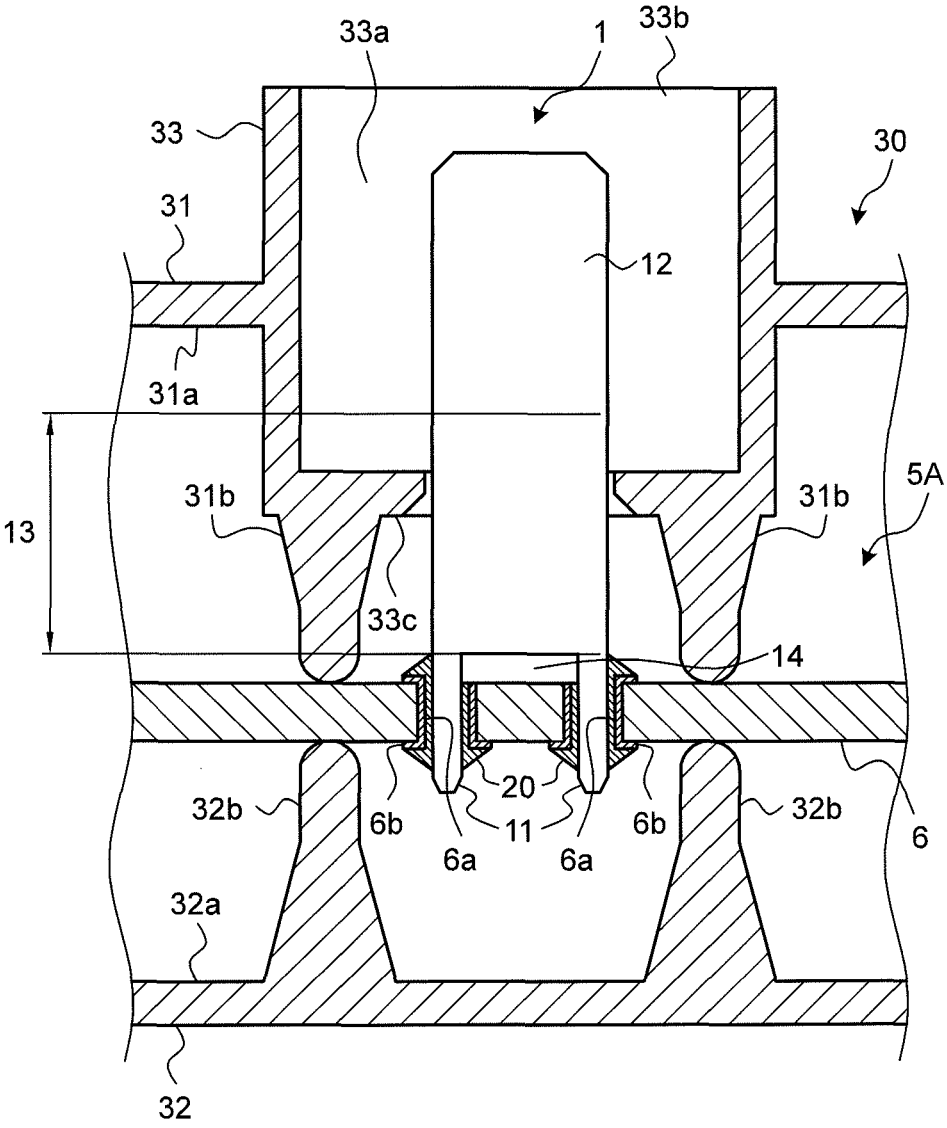
FIG. 1 is a partial sectional view illustrating a substrate terminal and a substrate with the terminal according to embodiments.
Figure 2:
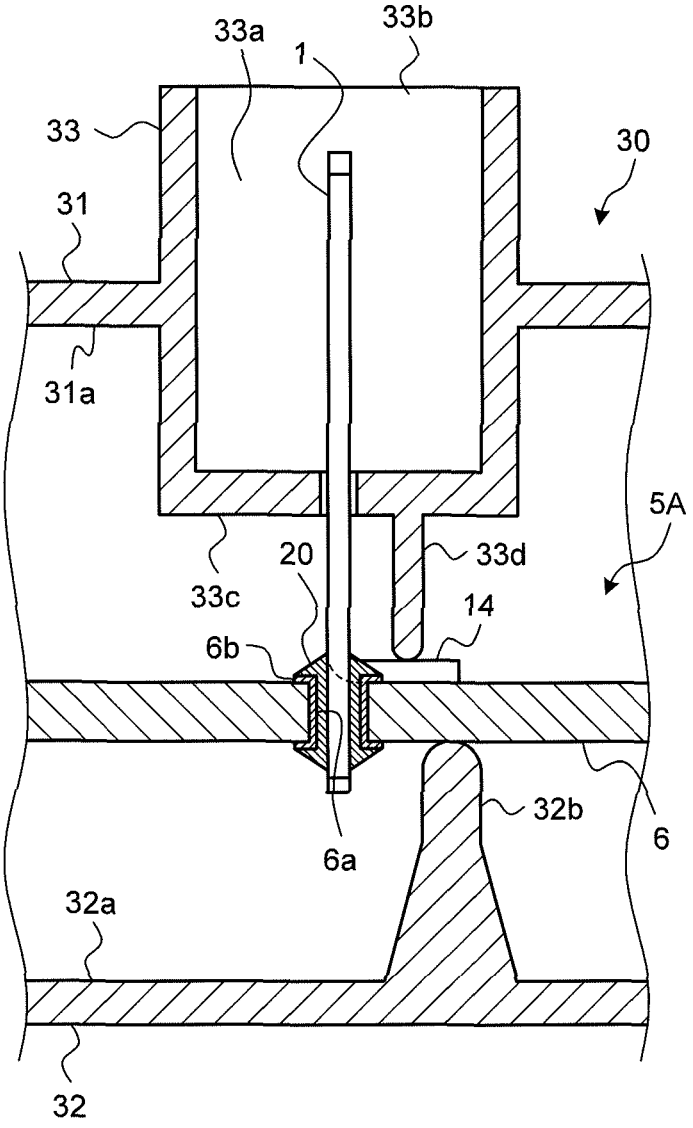
FIG. 2 is a partial sectional view illustrating the substrate terminal and the substrate with the terminal according to the embodiments.

A reference numeral 1 in FIG. 1 and FIG. 2 indicates the substrate terminal in the embodiment. A reference numeral 5A indicates the substrate with the terminal in the embodiment. The substrate with the terminal 5A is configured by attaching at least one substrate terminal 1 to a substrate 6 by soldering. The substrate with the terminal 5A is used for a junction box, for example. The substrate 6 in this example is what is called a printed board. FIG. 1 and FIG. 2 are partial sectional views illustrating other parts excluding the substrate terminal 1 by sections.

The substrate terminal 1 is soldered to the substrate 6 so as to establish electric connection with a wiring of the substrate 6. The substrate terminal 1 establishes electric connection with an opposite-side terminal (not illustrated) when the opposite-side terminal is connected to the substrate terminal 1. The opposite-side terminal is provided alone or as a connector on an electronic components (not illustrated) such as a relay and a fuse, an electric wire or a wiring harness (not illustrated), or an electronic device (not illustrated) such as an electronic control device, for example.

The substrate terminal 1 is a terminal fitting formed by molding a conductive metal material into a predetermined male shape or female shape. The substrate terminal 1 may be a male terminal or a female terminal. The substrate terminal 1 may be a terminal molded into a plate-like form (what is called tab-like form) or a bar-like form. In the embodiment, the male and plate-like substrate terminal 1 is described as an example. For example, the substrate terminal 1 in this example is press-molded into the following shape from a plate-like base member.

The substrate terminal 1 includes at least one substrate connection portion 11 that is inserted into a hole portion (through-hole) 6*a* in the substrate 6 from one surface side of the substrate 6 and is soldered together with the hold portion 6*a*. A land 6*b* that is electrically coupled to the wiring of the substrate 6 is formed on the peripheral edge of the hole portion 6*a*. The substrate connection portion 11 is therefore soldered together with the hole portion 6*a* and the land 6*b*. The land 6*b* in this example has a cylindrical portion connecting two surfaces of the substrate 6 in the hole portion 6*a*. In this case, the substrate connection portion 11 is inserted into an inner part of the cylindrical portion of the land 6*b*. Accordingly, in this example, the inner part of the cylindrical portion of the land 6*b* is referred to as the hole portion 6*a*. In the substrate terminal 1, the orthogonal direction relative to the surfaces of the substrate 6 corresponds to the insertion direction of the substrate connection portion 11 into the hole portion 6*a*. The substrate connection portion 11 is made to extend with the insertion direction thereof along the longitudinal direction. The substrate connection portion 11 in this example has a rectangular main body part extending in the insertion direction and a front end part projecting from the main body part in a lancet tip-like form. The substrate connection portion 11 is inserted into the hole portion 6*a* from the front end part and is soldered to the hole portion 6*a* on the main body part thereof.

As described above, the substrate terminal 1 is molded into the plate-like form. In this example, the substrate connection portion 11 is also molded into a plate-like form. The hole portion 6*a* is formed to have a circular shape such that the plate-like substrate connection portion 11 is inserted thereinto. When the substrate connection portion 11 in this example is attached to the substrate 6, the substrate connection portion 11 is pressed into the hole portion 6*a* so as to be made into a self-supporting state on the substrate 6 before being soldered. Accordingly, the substrate connection portion 11 and the hole portion 6*a* are formed to have such sizes that the substrate connection portion 11 can be pressed into the hole portion 6*a*.

Furthermore, the substrate terminal 1 has a terminal connection portion 12 that is connected to an opposite-side terminal as a female terminal. The opposite-side terminal is inserted to the terminal connection portion 12 in the same direction as the insertion direction of the substrate connection portion 11 into the hole portion 6*a*. The terminal connection portion 12 is therefore molded into a rectangular shape so as to extend with the insertion direction thereof along the longitudinal direction.

The substrate connection portion 11 and the terminal connection portion 12 are connected to each other on the same plane. In the substrate terminal 1, an intermediate portion 13 that connects the substrate connection portion 11 and the terminal connection portion 12 on the same plane is provided on the same plane.

The substrate terminal 1 further includes at least one substrate abutting portion 14 that is made to project in the direction orthogonal to the insertion direction of the substrate connection portion 11 into the corresponding hole portion 6*a* and is made to abut against the one surface of the substrate 6 with the substrate connection portion 11 and the hole portion 6*a* soldered. The substrate abutting portion 14 in this case is made to project in the direction orthogonal to the above-mentioned same plane. A projecting end of the substrate abutting portion 14 in the projecting direction is the side at which a front end part of the substrate connection portion 11 is formed on a plate-like base member forming the substrate connection portion 11, the terminal connection portion 12, the intermediate portion 13, and the substrate abutting portion 14. Furthermore, a projection base point of the substrate abutting portion 14 is a root side of the substrate connection portion 11 on the base member. The substrate abutting portion 14 is formed by bending processing with the base point serving as a bending portion. The substrate abutting portion 14 in this example corresponds to a piece portion extending in the projecting direction thereof. It should be noted that the bending processing is not necessarily limited to be made by press processing.

In the substrate terminal 1, one surface of the substrate abutting portion 14 is made to abut against the one surface of the substrate 6. No land and no wiring are provided on a part of the substrate 6 that abuts against the substrate abutting portion 14. In the substrate terminal 1, the substrate connection portion 11 is soldered to the hole portion 6*a* with the substrate abutting portion 14 and the substrate 6 abutting against each other.

In the substrate terminal 1, the substrate connection portion 11, the terminal connection portion 12, and the intermediate portion 13 are disposed on the same plane. When the opposite-side terminal is inserted to the terminal connection portion 12, pressing force acting on the terminal connection portion 12 with the insertion is transmitted to solder portions 20 formed between substrate connection portions 11 and respective hole portions 6*a* through the intermediate portion 13. In the substrate terminal 1, an abutment part between the substrate abutting portion 14 and the substrate 6 can also receive the pressing force. The pressing force is therefore received by the abutment part and the solder portions 20 in a dispersed manner. Accordingly, the substrate terminal 1 can reduce load on the solder portions 20 when the opposite-side terminal is inserted to the terminal connection portion 12 and can reduce stress concentration on the solder portions 20, thereby keeping an electric connection state between the substrate connection portions 11 and the wiring of the substrate 6.

To be specific, in the substrate terminal 1, two substrate connection portions 11 are provided at an interval and the substrate abutting portion 14 is made to project from between the two substrate connection portions 11 at the root side.

At least one substrate terminal 1 molded to have the above-mentioned shape is soldered to the substrate 6 as described above so as to configure the substrate with the terminal 5A together with the substrate 6. In the soldering, the substrate connection portion 11 is pressed into the hole portion 6*a* until the substrate abutting portion 14 abut against the substrate 6. Accordingly, the substrate terminal 1 can be made into a self-supporting state on the substrate 6 with no jig or the like. Furthermore, the substrate terminal 1 can be disposed on the substrate 6 at a position and a height within ranges of tolerance for designed values with no jig or the like. While the substrate terminal 1 is kept to be in the self-supporting state, the main body part of the substrate connection portion 11 is soldered together with the hole portion 6*a* and the land 6*b*.

The substrate with the terminal 5A formed in this manner is accommodated in a housing 30, for example. In the housing 30, the substrate 6 is attached to a constituent member of the housing 30. The housing 30 includes a first cover member 31 and a second cover member 32 as the constituent members thereof, for example. The first cover member 31 covers the substrate with the terminal 5A from one surface side. The second cover member 32 covers the substrate with the terminal 5A from the other surface side. As depending on the sizes of the substrate 6, projecting portions 31*b* and 32*b* are formed on the first cover member 31 and the second cover member 32, respectively. The projecting portions 31*b* and 32*b* are made to project toward the surfaces of the substrate 6 from outer wall surfaces 31*a* and 32*a*, respectively. The projecting portions 31*b* and 32*b* are made to abut against the flat planes of the substrate 6.

The terminal connection portion 12 of the substrate terminal 1 is exposed to the outside of the housing 30. The first cover member 31 includes a terminal accommodation chamber 33 that accommodates the substrate with the terminal 5A in a state of covering the substrate connection portion 11 and the substrate abutting portion 14 together with the substrate 6 and exposing the terminal connection portion 12. The terminal accommodation chamber 33 is integrated with the first cover member 31, so as to be attached to the substrate 6. The terminal accommodation chamber 33 includes an accommodation space 33*a* and an insertion port 33*b*. The accommodation space 33*a* accommodates therein the terminal connection portion 12 so as to surround it. An opposite-side terminal is inserted through the insertion port 33*b* when the opposite-side terminal is connected to the terminal connection portion 12. One terminal accommodation chamber 33 may be formed as a chamber for one terminal connection portion 12 or may be a chamber that accommodates a plurality of terminal connection portions 12.

With the above-mentioned shape of the substrate terminal 1, the substrate terminal 1 and the substrate with the terminal 5A can disperse the pressing force acting on the terminal connection portion 12 from the opposite-side terminal to the abutment parts between the substrate abutting portion 14 and the substrate 6 and the solder portion 20 when the opposite-side terminal is inserted to the terminal connection portion 12, thereby reducing the load on the solder portion 20. That is to say, the substrate terminal 1 and the substrate with the terminal 5A can reduce the load on the solder portion 20 with a simple configuration and keep the electric connection state between the substrate connection portion 11 and the wiring of the substrate 6. The substrate terminal 1 included in the substrate with the terminal 5A can improve durability of the substrate with the terminal 5A. Furthermore, the substrate with the terminal 5A can improve its durability by using the substrate terminal 1.

The substrate terminal 1 and the substrate with the terminal 5A can disperse the pressing force in connection with the opposite-side terminal with the shape of the substrate terminal 1, thereby eliminating the necessity of a new part for dispersion. The substrate terminal 1 and the substrate with the terminal 5A can therefore reduce the cost (cost of parts themselves and cost of a mold) for cost that is required for the new part. The substrate terminal 1 is not molded into a crank form unlike the conventional terminal. With this, the substrate terminal 1 and the substrate with the terminal 5A can reduce a material for an amount of an intermediate portion of the crank form when the entire length of the substrate terminal 1 is the same as that of the conventional terminal, thereby reducing the cost also in this point. Moreover, the substrate terminal 1 can be made into the self-supporting state on the substrate 6 before soldering. That is to say, the substrate terminal 1 and the substrate with the terminal 5A can eliminate the necessity of a jig for holding the substrate terminal 1 on the substrate 6 before the soldering, thereby simplifying an attachment process and reducing the cost.

If the projection end of the substrate abutting portion 14 on the base member is provided at the intermediate portion 13 side and bending is made in the opposite direction to that in the above-mentioned example, an arc-like portion at the bending inner side makes contact with the substrate 6. Due to this, the surface of the substrate abutting portion 14 cannot be made to abut against the one surface of the substrate 6 and the substrate abutting portion 14 possibly scratches the substrate 6. Unlike this bending manner, bending is made as described above in the substrate terminal 1, so that a void is formed between the arc-like portion at the bending outer side and the substrate 6. The void can enable the surface of the substrate abutting portion 14 to abut against the one surface of the substrate 6, thereby eliminating the possibility that the substrate abutting portion 14 scratches the substrate 6.

Furthermore, corners R with the press processing are, in principle, required to be provided between the roots of the substrate connection portions 11 and the intermediate portion 13 in order to reduce stress concentration, mold scraping, and the like on the roots of the substrate connection portions 11. The substrate abutting portion 14 on which bending as described above has been made is provided on parts of the intermediate portion 13 adjacent to the roots of the substrate connection portions 11 in the substrate terminal 1, thereby reducing stress concentration, mold scraping, and the like on the roots of the substrate connection portions 11 without providing the corners R.

In the description hereinbefore, the configuration in order to reduce the load on the solder portions 20 when the opposite-side terminal is connected has been explained. The opposite-side terminal is detached from the substrate terminal 1 after connection in some cases when a part is exchange or maintenance is performed, for example. When the opposite-side terminal is detached, tensile force with detachment of the opposite-side terminal acts on the terminal connection portion 12. In the substrate terminal 1, the tensile force concentrates on the solder portions 20 unless a configuration receiving the tensile force is provided.

In the substrate terminal 1, an accommodation chamber abutting portion abutting against the terminal accommodation chamber 33 is provided and the accommodation chamber abutting portion is made to receive the tensile force when the opposite-side terminal is detached. The accommodation chamber abutting portion is formed so as to be locked at an abutment point against the terminal accommodation chamber 33 with the substrate abutting portion 14 and the substrate 6 abutting against each other when the tensile force (force in the opposite direction to the insertion direction of the opposite-side terminal) acts.

In this example, the plate-like substrate abutting portion 14 having the surface parallel with the surface of the substrate 6 is interposed between the substrate 6 and the terminal accommodation chamber 33. The substrate abutting portion 14 is therefore made to also have a function of the accommodation chamber abutting portion. That is to say, the substrate abutting portion 14 corresponds to a portion integrated with the accommodation chamber abutting portion. The one surface of the substrate 6 and the terminal accommodation chamber 33 hold the substrate abutting portion 14 therebetween so as to impart, to the substrate abutting portion 14, a function of receiving the pressing force when the opposite-side terminal is connected and a function of receiving the tensile force when the opposite-side terminal is detached.

An abutment site of the terminal accommodation chamber 33 against the substrate abutting portion 14 (accommodation chamber abutting portion) is, for example, an end portion 33*c* of the terminal accommodation chamber 33 in the insertion direction of the opposite-side terminal into the terminal connection portion 12. In other words, the end portion 33*c* is the outer wall portion or the outer wall surface of the terminal accommodation chamber 33 that is present at the opposite side to the accommodation space 33*a* for accommodating the terminal connection portion 12 and the insertion port 33*b* through which the opposite-side terminal is inserted in the attachment and detachment direction of the opposite-side terminal to and from the terminal connection portion 12. When the terminal accommodation chamber 33 can be made close to the substrate 6, the end portion 33*c* and the one surface of the substrate 6 hold the substrate abutting portion 14 therebetween.

The end portion 33*c* and the one surface of the substrate 6 are, however, distanced from each other and the end portion 33*c* and the substrate abutting portion 14 cannot make contact with each other in this example. For example, as illustrated in FIG. 2, a projecting portion 33*d* that is made to project toward the substrate 6 from the end portion 33*c* is provided on the end portion 33*c* and the projecting portion 33*d* and the one surface of the substrate 6 are made to hold the substrate abutting portion 14 therebetween.

The substrate terminal 1 can receive the tensile force by the substrate abutting portion 14 (accommodation chamber abutting portion) and the end portion 33*c* or the projecting portion 33*d* of the terminal accommodation chamber 33 when the opposite-side terminal is detached. The substrate terminal 1 and the substrate with the terminal 5A can therefore reduce load acting on the solder portions 20 when the opposite-side terminal is detached. That is to say, the substrate terminal 1 and the substrate with the terminal 5A can further reduce the load on the solder portions 20 with a simple configuration and keep the electric connection state between the substrate connection portions 11 and the wiring of the substrate 6. Accordingly, when the substrate terminal 1 is formed as the substrate with the terminal 5A, durability of the substrate with the terminal 5A can be further improved. Furthermore, durability of the substrate with the terminal 5A itself can be improved by using the substrate terminal 1.

Modification

In this modification, another method in the case where the end portion 33*c* of the terminal accommodation chamber 33 and the one surface of the substrate 6 are distanced from each other and the end portion 33*c* and the substrate abutting portion 14 cannot make contact with each other is described.

Figure 3:
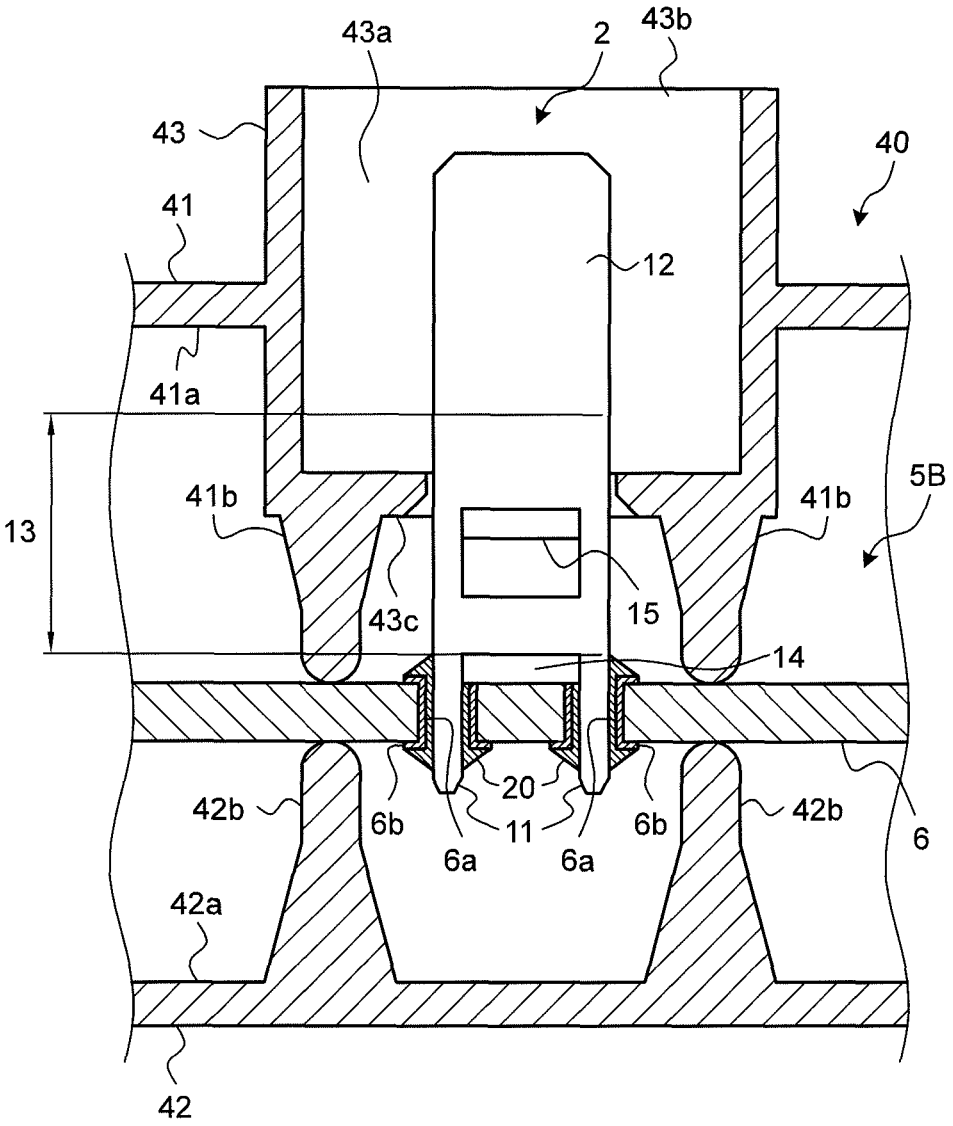
FIG. 3 is a partial sectional view illustrating a substrate terminal and a substrate with the terminal according to a modification.
Figure 4:
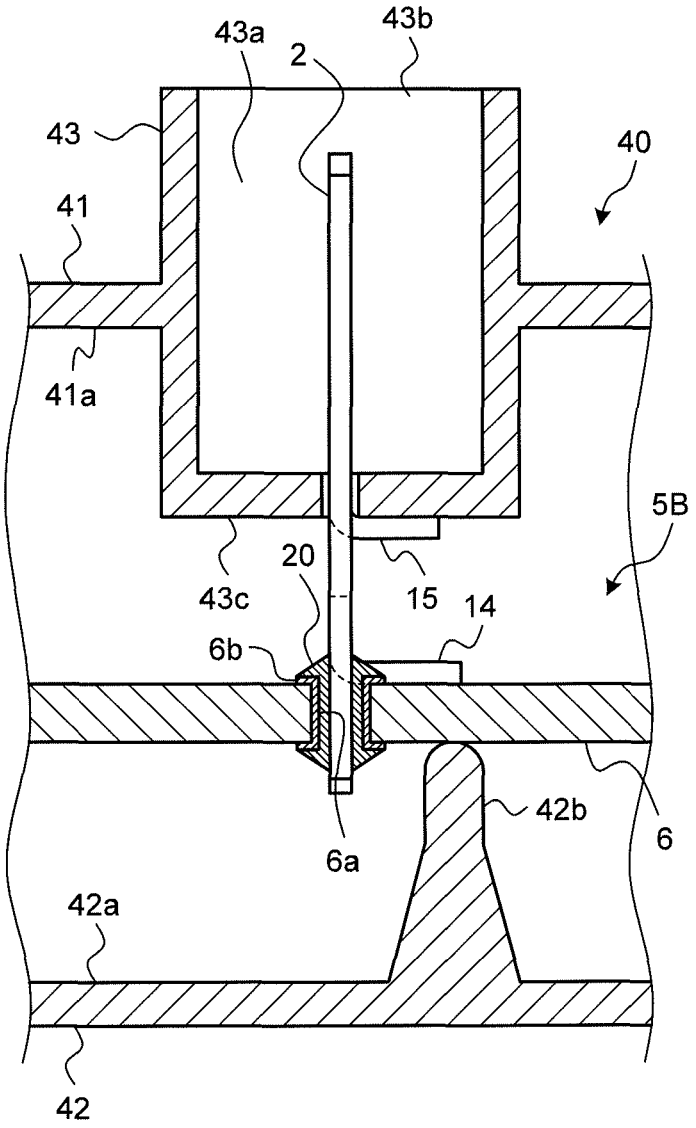
FIG. 4 is a partial sectional view illustrating the substrate terminal and the substrate with the terminal according to the modification.

A reference numeral 2 in FIG. 3 and FIG. 4 indicates a substrate terminal in the modification. FIG. 3 and FIG. 4 are partial cross-sectional views illustrating other parts excluding the substrate terminal 2 by cross sections. A reference numeral 5B indicates a substrate with the terminal in the modification. The substrate with the terminal 5B is configured by attaching at least one substrate terminal 2 to the substrate 6 in the modification by soldering. A reference numeral 40 indicates a housing in the modification. The housing 40 accommodates therein the substrate with the terminal 5B and includes first and second cover members 41 and 42 equivalent to the first and second cover members 31 and 32 in the embodiment. Projecting portions 41*b* and 42*b* that are made to project toward the surfaces of the substrate 6 from outer wall surfaces 41*a* and 42*a* are formed on the first and second cover members 41 and 42, respectively. Furthermore, the first cover member 41 includes a terminal accommodation chamber 43 equivalent to the terminal accommodation chamber 33 in the embodiment. The terminal accommodation chamber 43 includes an accommodation space 43*a* and an insertion port 43*b* through which the opposite-side terminal is inserted. It should be noted that in the terminal accommodation chamber 43, no projecting portion abutting against the substrate abutting portion 14 is provided.

The substrate terminal 2 in the modification is configured by changing the substrate terminal 1 in the embodiment as follows. The substrate terminal 2 includes the substrate connection portions 11, the terminal connection portion 12, the intermediate portion 13, and the substrate abutting portion 14 equivalent to those in the substrate terminal 1. In the substrate terminal 2 in the modification, an accommodation chamber abutting portion 15 for receiving tensile force when the opposite-side terminal is detached is separately provided on the terminal equivalent to the substrate terminal 1 in the embodiment.

The accommodation chamber abutting portion 15 is that as described in the above-mentioned embodiment and is formed so as to be locked at an abutment point against the terminal accommodation chamber 43 with the substrate abutting portion 14 and the substrate 6 abutting against each other when the tensile force acts in detachment of the opposite-side terminal. The substrate terminal 2 and the substrate with the terminal 5B configured as described above can provide the same effects as those in the embodiment.

The accommodation chamber abutting portion 15 can be formed as a projecting portion that is made to project from the intermediate portion 13 along an end portion 43*c* of the terminal accommodation chamber 43 in order to make the accommodation chamber abutting portion 15 abut against the end portion 43*c* with the substrate abutting portion 14 and the substrate 6 abutting against each other, for example.

For example, the accommodation chamber abutting portion 15 may be formed by fixing at least another member such as a piece member to the wall surface of the intermediate portion 13. In the modification, a piece portion that is made to project by making cuts on three sides of a rectangle as the piece portion other than one side while the one side is a bending portion and folding the rectangle from the bending portion by press processing on a center portion of the intermediate portion 13 is provided as the accommodation chamber abutting portion 15. In this case, the outer shape of the substrate terminal 2 is the same as the outer shape of the substrate terminal 1 in the embodiment other than the accommodation chamber abutting portion 15. When a plurality of substrate terminals 2 are installed on the substrate 6, the accommodation chamber abutting portion 15 does not require enlargement of a pitch between the substrate terminals 2 in the lateral direction. The substrate terminal 2 can therefore reduce load on the solder portions 20 when the opposite-side terminal is detached and prevent the substrate with the terminal 5B from increasing in size. Furthermore, when the plurality of substrate terminals 2 are collectively punched out from one plate member, the number of terminals same as that of the substrate terminal 1 in the embodiment can be manufactured. In addition, in the substrate terminal 2, a hole portion is formed on the intermediate portion 13, thereby moderating the stress on the intermediate portion 13 in the lateral direction (direction orthogonal to the insertion direction of the opposite-side terminal and short-side direction of the main body parts of the substrate connection portions 11).

Although not illustrated in the drawings, the accommodation chamber abutting portion 15 may be a piece portion that is made to project along the end portion 43*c* from at least one of both ends (on a portion that is not continuous to the substrate connection portions 11, the terminal connection portion 12, and the substrate abutting portion 14) of the intermediate portion 13. When two piece portions (accommodation chamber abutting portions 15) are provided, they may be bent in the same direction from both ends of the intermediate portion 13 or may be bent in the opposite directions.

Although not illustrated in the drawings, the accommodation chamber abutting portion 15 may abut against the projecting portion that is made to project toward the substrate 6 from the end portion 43*c* in the same manner as the embodiment. This configuration is effective in the case where a sufficient extending amount of the projecting portion cannot be ensured and the substrate abutting portion 14 cannot have the function of receiving the pressing force when the opposite-side terminal is connected and the function of receiving the tensile force when the opposite-side terminal is detached in combination.

The substrate terminal according to the present invention disperses pressing force acting on the terminal connection portion from the opposite-side terminal to an abutment part of the substrate abutting portion against the substrate and a solder portion (portion on which the substrate connection portion and the hole portion are soldered) when the opposite-side terminal is inserted to the terminal connection portion, thereby reducing load on the solder portion. That is to say, the substrate terminal can reduce the load on the solder portion with a simple configuration by providing the substrate abutting portion that is made to abut against the substrate on the substrate terminal.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A substrate terminal comprising:

at least one substrate connection portion configured to be inserted into a hole portion in a substrate from one surface side of the substrate and to be soldered together with the hole portion;

a terminal connection portion into which an opposite-side terminal is inserted in a direction same as an insertion direction of the substrate connection portion into the hole portion and configured to be connected to the opposite-side terminal;

an intermediate portion configured to connect the substrate connection portion and the terminal connection portion; and at least one substrate abutting portion configured to be made to project in a direction orthogonal to the insertion direction and to be made to abut against the one surface of the substrate in a state where the substrate connection portion and the hole portion are soldered, wherein the substrate abutting portion is formed on a base member, including the substrate abutting portion, the substrate connection portion, the terminal connection portion, and the intermediate portion, by bending processing with a side that includes a front end part of the substrate connection portion serving as a projecting end in a projecting direction, a root side of the substrate connection portion serving as a base point of the projection, and the base point serving as a bending portion.

2. The substrate terminal according to claim 1, wherein the substrate connection portion, the terminal connection portion, and the intermediate portion are disposed on the same plane.

3. The substrate terminal according to claim 1, further comprising:

an accommodation chamber abutting portion configured to abut against a terminal accommodation chamber attached to the substrate and accommodating the terminal connection portion, wherein the accommodation chamber abutting portion is formed so as to be locked at an abutment point against the terminal accommodation chamber in a state where the substrate abutting portion and the substrate are abutted against each other when a force in an opposite direction to the insertion direction acts.

4. The substrate terminal according to claim 2, further comprising:

an accommodation chamber abutting portion configured to abut against a terminal accommodation chamber attached to the substrate and accommodating the terminal connection portion, wherein the accommodation chamber abutting portion is formed so as to be locked at an abutment point against the terminal accommodation chamber in a state where the substrate abutting portion and the substrate are abutted against each other when a force in an opposite direction to the insertion direction acts.

5. The substrate terminal according to claim 3, wherein the substrate abutting portion is integrated with the accommodation chamber abutting portion and is held between the terminal accommodation chamber and the one surface of the substrate.

6. The substrate terminal according to claim 1, wherein the substrate abutting portion is held between a terminal accommodation chamber attached to the substrate and accommodating the terminal connection portion and the one surface of the substrate.

7. The substrate terminal according to claim 2, wherein the substrate abutting portion is held between a terminal accommodation chamber attached to the substrate and accommodating the terminal connection portion and the one surface of the substrate.

8. The substrate terminal according to claim 1, wherein the two substrate connection portions are provided at an interval, and the substrate abutting portion is made to project from between root sides of the two substrate connection portions.

9. The substrate terminal according to claim 2, wherein the two substrate connection portions are provided at an interval, and the substrate abutting portion is made to project from between root sides of the two substrate connection portions.

10. The substrate terminal according to claim 3, wherein the two substrate connection portions are provided at an interval, and the substrate abutting portion is made to project from between root sides of the two substrate connection portions.

11. The substrate terminal according to claim 5, wherein the two substrate connection portions are provided at an interval, and the substrate abutting portion is made to project from between root sides of the two substrate connection portions.

12. The substrate terminal according to claim 6, wherein the two substrate connection portions are provided at an interval, and the substrate abutting portion is made to project from between root sides of the two substrate connection portions.

13. The substrate terminal according to claim 6, wherein the substrate abutting portion is held between a projecting portion that is made to project toward the substrate from an end portion of a substrate side of the terminal accommodation chamber and the one surface of the substrate.

14. The substrate terminal according to claim 8, wherein the substrate abutting portion is held between a projecting portion that is made to project toward the substrate from an end portion of a substrate side of the terminal accommodation chamber and the one surface of the substrate.

* * * * *